US005574004A

United States Patent [19]

Carr

[11] Patent Number: 5,574,004

[45] Date of Patent: Nov. 12, 1996

[54] CARBONATE BUILT NON-BLEACHING LAUNDRY DETERGENT COMPOSITION CONTAINING A POLYMERIC POLYCARBOXYLATE AND A ZINC SALT

[75] Inventor: Charles D. Carr, Yardley, Pa.

[73] Assignee: Church & Dwight Co., Inc., Princeton, N.J.

[21] Appl. No.: 340,064

[22] Filed: Nov. 15, 1994

[51] Int. Cl.[6] ..... C11D 3/10; C11D 3/04; C11D 3/60; C11D 17/06

[52] U.S. Cl. ..... 510/361; 510/351; 510/356; 510/508; 510/509

[58] Field of Search ..... 252/174.14, 174.24, 252/174.23, DIG. 2, 551, 174.21, 174

[56] References Cited

U.S. PATENT DOCUMENTS

| | | | |
|---|---|---|---|
| Re. 35,045 | 10/1995 | Winston et al. | 134/40 |
| 3,901,727 | 8/1975 | Loudas | 134/4 |
| 3,994,744 | 11/1976 | Anderle et al. | 134/4 |
| 4,002,571 | 1/1977 | Anderle et al. | 252/90 |
| 4,125,370 | 11/1978 | Nicol | 8/137.5 |
| 4,150,024 | 4/1979 | Syldatk et al. | 260/239.3 R |
| 4,265,790 | 5/1981 | Winston et al. | 252/532 |
| 4,319,036 | 3/1982 | Klemarczyk et al. | 560/120 |
| 4,400,173 | 8/1983 | Beavan | 8/107 |
| 4,430,243 | 2/1984 | Bragg | 252/91 |
| 4,438,009 | 3/1984 | Brusky et al. | 252/90 |
| 4,464,292 | 8/1984 | Lengyel | 252/532 |
| 4,490,271 | 12/1984 | Spadini et al. | 252/174.23 |
| 4,521,332 | 6/1985 | Milora | 252/527 |
| 4,652,392 | 3/1987 | Baginski et al. | 252/109 |
| 4,711,740 | 12/1987 | Carter et al. | 252/174.24 |
| 4,820,441 | 4/1989 | Evans et al. | 252/174.18 |
| 4,828,721 | 5/1989 | Bollier et al. | 252/8.7 |
| 4,849,125 | 5/1989 | Seiter et al. | 252/109 |
| 4,902,434 | 2/1990 | Dickerson | 252/8.6 |
| 4,933,101 | 6/1990 | Cilley et al. | 252/99 |
| 4,992,212 | 2/1991 | Corring et al. | 252/542 |
| 5,055,218 | 10/1991 | Getty et al. | 252/94 |
| 5,151,208 | 9/1992 | Huijben et al. | 252/174.14 |
| 5,152,910 | 10/1992 | Savio et al. | 252/95 |
| 5,152,911 | 10/1992 | Savio et al. | 252/95 |
| 5,234,506 | 8/1993 | Winston et al. | 134/40 |
| 5,318,719 | 6/1994 | Hughes et al. | 252/174.23 |
| 5,431,836 | 7/1995 | Carr et al. | 252/174.14 |
| 5,431,838 | 7/1995 | Carr et al. | 252/174.14 |
| 5,443,751 | 8/1995 | Mazzola | 252/174.13 |

*Primary Examiner*—Ardith Hertzog
*Attorney, Agent, or Firm*—Irving Fishman

[57] ABSTRACT

A non-bleaching laundry detergent composition, wherein the solids content comprises an active surfactant, at least about 70 wt. % of a water soluble alkaline carbonate, e.g., sodium carbonate, a minor amount of a polymeric polycarboxylate, e.g., an acrylic acid polymer, and a minor amount of elemental zinc in the form of a water soluble salt, e.g., a hydrated or anhydrous zinc sulfate, such as zinc sulfate heptahydrate or monohydrate, based on the total weight of solids in the composition. Incorporation of a polymeric polycarboxylate and zinc ions in the foregoing laundry detergent composition containing carbonate ions has the effect of significantly reducing fabric encrustation caused by the precipitation of calcium carbonate.

16 Claims, No Drawings

CARBONATE BUILT NON-BLEACHING LAUNDRY DETERGENT COMPOSITION CONTAINING A POLYMERIC POLYCARBOXYLATE AND A ZINC SALT

BACKGROUND OF THE INVENTION

1. Field of the Invention

This invention relates to novel laundry detergent compositions having a high water-soluble alkaline carbonate builder content, the use of which results in reduced fabric encrustation.

2. Information Disclosure Statement Including Description of Related Art

The following information is being disclosed under the provisions of 37 CER 1.56, 1.97 and 1.98.

Laundry detergent compositions comprising a water-soluble alkaline carbonate are well-known in the art. For example, it is conventional to use such a carbonate as a builder in detergent compositions which supplement and enhance the cleaning effect of an active surfactant present in the composition. Such builders improve the cleaning power of the detergent composition, for instance, by the sequestration or precipitation of hardness causing metal ions such as calcium, peptization of soil agglomerates, reduction of the critical micelle concentration, and neutralization of acid soil, as well as by enhancing various properties of the active detergent, such as its stabilization of solid soil suspensions, solubilization of water-insoluble materials, emulsification of soil particles, and foaming and sudsing characteristics. Other mechanisms by which builders improve the cleaning power of detergent compositions are probably present but are less well understood. Builders are important not only for their effect in improving the cleaning ability of active surfactants in detergent compositions, but also because they allow for a reduction in the amount of the surfactant used in the composition, the surfactant being generally much more costly than the builder.

Two important classes of builders have been widely used in recent years, viz., phosphorus containing salts such as sodium tripolyphosphate (STPP) which are very effective in sequestering calcium and magnesium ions without precipitating them, and the water-soluble alkaline carbonates mentioned previously such as sodium carbonates which may be used in amounts up to 90 wt. % of the composition and which effectively precipitate the calcium ions. However, phosphorus-containing builders have been found to cause a serious problem of eutrophication of lakes, rivers and streams when present in detergent compositions in relatively large amounts, resulting in the passage of laws in several states mandating a drastic reduction in their use. While the use of water-soluble alkaline carbonate builders do not cause eutrophication, they result in the unrelated problem of calcium carbonate precipitation, leading to, for example, fabric encrustation due to the deposition of the calcium carbonate on the fiber surfaces of fabrics which in turn causes fabric to have a stiff hand and gives colored fabrics a faded appearance.

Polymeric polycarboxylates such as polyacrylates are also known in the detergent art as effective sequestering and dispersing agents as well as crystal growth inhibitors. However, such polycarboxylates have limited biodegradability which presents an environmental problem if they are used in relatively large amounts.

The following prior art references may be considered relevant or material to the invention claimed herein.

U.S. Pat. Nos. 4,265,790, issued May 5, 1981 to Winston et al., and 4,464,292, issued Aug. 7, 1984 to Lengyel, disclose detergent compositions comprising an ethoxylated alcohol and an ethoxy sulfate as a combination of nonionic and anionic surfactants, and over 70 wt % of anhydrous sodium carbonate (soda ash) as a detergent builder.

U.S. Pat. No. 4,430,243, issued Feb. 7, 1984 to Bragg, discloses laundry bleaching and detergent compositions comprising a peroxygen bleaching agent and a catalytic system therefor, such system comprising a heavy metal cation of defined bleach catalytic activity, particularly copper, manganese or iron cations, an auxiliary metal having little or no bleach catalytic activity, particularly zinc or aluminum cations, and a sequestrant, e.g., ethylenediaminetetraacetic acid.

U.S. Pat. No. 4,490,271, issued Dec. 25, 1984 to Spadini et al., discloses detergent compositions comprising an active surfactant, up to 80% of a non-phosphorus detergent builder such as a water-soluble carbonate, and a polyacrylate such as a copolymer of acrylic acid with any of various comonomers.

U.S. Pat. No. 4,521,332, issued Jun. 4, 1985 to Milora, discloses highly alkaline liquid cleaning compositions comprising a nonionic surfactant, 10 to 45 wt. % of sodium hydroxide, 0.04 to 4 wt. % of a polyacrylic acid salt, 0 to 15 wt. % of an alkali metal phosphate builder such as STPP, 0.5 to 20 wt. % of a "building agent" such as sodium carbonate, and 6 to 60 wt. % of water.

U.S. Pat. No. 4,711,740, issued Dec. 8, 1987 to Carter et al., discloses detergent compositions comprising a "detergent active" compound, i.e., a surfactant, a detergent builder which is a water-soluble carbonate, e.g. sodium carbonate in an amount of "at least 5% by weight, such as from 10% to 40%, preferably 10% to 30% weight, though an amount up to 75% could possible be used if desired in special products," a water insoluble carbonate, e.g., calcium carbonate (calcite) in an amount of 5 to 60 wt. %, as seed crystals for precipitated calcium carbonate which is thus prevented from being deposited on fabrics; and a copolymer of a carboxylic monomer, e.g., acrylic acid, and a non-carboxylic monomer, such copolymer being present in an amount of 0.1 to 10 wt. % and acting as a colloid stabilizer for the precipitated calcium carbonate. Other detergency builders such as STPP may also be present.

U.S. Pat. No. 4,820,441, issued Apr. 11, 1989 to Evans et al., discloses granular detergent compositions which may contain in addition to an active surfactant, 5 to 75 wt. % of a crystal growth modified, carbonate-based structurant salt, 0.1 to 20 wt. % of a polymeric polycarboxylate as crystal growth modifier based on the weight of the structurant salt, and 0 to 40 wt. % of STPP. The structurant salt may contain sodium sulfate as well as sodium carbonate and sodium bicarbonate, and the two tables under the heading "PRODUCTS OF THE INVENTION" in columns 8 and 9 of the patent show a maximum of 40 wt. % of sodium carbonate in the final product composition.

U.S. Pat. No. 4,849,125, issued Jul. 18, 1989 to Seiter et al., discloses phosphate-reduced, granular, free-flowing detergent compositions comprising 4 to 40 wt. % of a nonionic surfactant, 3 to 20 wt. % of an anionic surfactant, 0.5 to 15 wt. % of a homopolymeric or copolymeric carboxylic acid or salt, 0 to 20 wt. % of STPP, and, optionally, up to 15 or 20 wt. % of sodium carbonate.

SUMMARY OF THE INVENTION

In accordance with this invention, a non-bleaching laundry detergent composition is provided wherein the solids content comprises an active surfactant, at least about 70 wt. % of a water-soluble alkaline carbonate, a minor amount of a polymeric polycarboxylate and a minor amount of elemental zinc in the form of a water soluble salt, which has the effect of reducing fabric encrustation. The term "polymeric polycarboxylate" includes homopolymers of monoethylenically unsaturated carboxylic acids and copolymers of such acids as hereinafter defined.

Incorporation of a polymeric polycarboxylate and zinc ions in the foregoing laundry detergent composition containing carbonate ions is intended to .preserve all the advantages of high carbonate content while minimizing negative interactions that will occur between the precipitation of calcium carbonate and the surfaces of the fabric being cleaned. For example, the composition is capable of providing excellent cleaning and whitening of fabrics while avoiding the problem of eutrophication which occurs when a substantial amount of a phosphorous containing builder such as STPP is present in the composition, and while minimizing the problem of fabric encrustation often present when the composition contains a large amount of carbonate builder.

The reduction in the amount of fabric encrustation when using the laundry detergent composition of this invention is apparently partly due to an effect of the combination of polymeric polycarboxylate and zinc ions at certain concentrations in inhibiting the precipitation of calcium carbonate on the substrate being cleaned, i.e., fabric surfaces.

DETAILED DESCRIPTION OF THE INVENTION

The water-soluble alkaline carbonate may be, for example, an alkali metal carbonate, bicarbonate or sesquicarbonate, preferably sodium or potassium carbonate, bicarbonate or sesquicarbonate, and most preferably sodium carbonate. A combination of more than one of such compounds may be used, e.g., sodium carbonate and sodium bicarbonate. The total water-soluble alkaline carbonate may be present in an amount, for example, of about 70 to 90 wt. %, preferably about 75 to 85 wt. %, based on the weight of the solids. If a combination of alkali metal carbonate and bicarbonate is used as the water-soluble carbonate, then the alkali metal carbonate, e.g., sodium carbonate, is preferably used in an amount of about 75 to 80 wt. % and the alkali metal bicarbonate, e.g., sodium bicarbonate, in an amount of about 0.1 to 15 wt. %.

The polymeric polycarboxylate employed in the composition may be, for example, a homopolymer or copolymer (composed of two or more co-monomers) of an alpha, beta-ethylenically unsaturated acid monomer such as acrylic acid, methacrylic acid, a diacid such as maleic acid, itaconic acid, fumaric acid, mesoconic acid, citraconic acid and the like, a monoester of a diacid with an alkanol, e.g., having 1–8 carbon atoms, and mixtures thereof. When the polymeric polycarboxylate is a copolymer, it may be a copolymer of more than one of the foregoing unsaturated acid monomers, e.g., acrylic acid and maleic acid, or a copolymer of at least one of such unsaturated acid monomers with at least one non-carboxylic alpha, beta-ethylenically unsaturated monomer which may be either relatively non-polar such as styrene or an olefinic monomer, such as ethylene, propylene or butene-1, or which has a polar functional group such as vinyl acetate, vinyl chloride, vinyl alcohol, alkyl acrylates, vinyl pyridine, vinyl pyrrolidone, or an amide of one of the delineated unsaturated acid monomers, such as acrylamide or methacrylamide. Certain of the foregoing copolymers may be prepared by aftertreating a homopolymer or a different copolymer, e.g., copolymers of acrylic acid and acrylamide by partially hydrolyzing a polyacrylamide.

Copolymers of at least one unsaturated carboxylic acid monomer with at least one non-carboxylic comonomer should contain at least about 50 mol % of polymerized carboxylic acid monomer.

The polymeric polycarboxylate should have a number average molecular weight of, for example about 1000 to 10,000, preferably about 2000 to 5000. To ensure substantial water solubility, the polymeric polycarboxylate is completely or partially neutralized, e.g., with alkali metal ions, preferably sodium ions, or with magnesium ions supplied by magnesium oxide or hydroxide which thus acts as the source of the added magnesium.

The polymeric polycarboxylate may be present in the detergent composition in an amount, for example, of about 0.05 to 5 wt. %, preferably about 0.1 to 2 wt. %, based on the weight of the total solids.

Water soluble zinc salts which may be used in preparing the detergent compositions of this invention are, for example, those having a solubility in water at 95° F. (35° C.) of at least about 0.2 ppm expressed as elemental zinc. Specific salts which may be utilized are, for example, zinc sulfate (hydrated or anhydrous), zinc acetate (hydrated or anhydrous), zinc chloride, zinc nitrate and zinc citrate. Sufficient zinc salt is added to the composition such that elemental zinc is present in an amount, for example, of up to about 20 wt. % based on the total solids. In general, the wash water before the addition of cleaning composition contains a calcium hardness of for example, about 10 to 450 ppm of calcium hardness expressed as $CaCO_3$ and a Ca/Mg molar ratio of, for example, about 5/1 to 1/1 may be present, in which case the elemental zinc in the detergent composition should be, for example, about 0.01 to 20 wt. %, preferably about 0.06 to 1 wt. % based on the weight of total solids in the composition. The foregoing ranges of amount of zinc in the detergent composition and the calcium and magnesium content of the wash water assume normal and accepted use of a detergent wherein the wash liquor contains about 0.1 to 1 wt. % of detergent solids during the washing operation.

The active surfactant component may be, for example, one or more of many suitable synthetic detergent active compounds which are commercially available and described in the literature, e.g , in "Surface Active Agents and Detergents" Volumes 1 and 2 by Schwartz, Perry and Berch. Several detergents and active surfactants are also described in, for example, U.S. Pat. Nos. 3,957,695; 3,865,754; 3,932,316 and 4,009,114. In general, the composition may include a synthetic anionic, nonionic, amphoteric or zwitterionic detergent active compound, or mixtures of two or more of such compounds.

More preferably, the laundry detergent compositions of this invention contain at least one anionic or nonionic surfactant, and, most preferably, a mixture of the two types of surfactant.

The contemplated water soluble anionic detergent surfactants are the alkali metal (such as sodium and potassium) salts of the higher linear alkyl benzene sulfonates and the alkali metal salts of sulfated ethoxylated and unethoxylated fatty alcohols, and ethoxylated alkyl phenols. The particular salt will be suitably selected depending upon the particular formulation and the proportions therein.

The sodium alkybenzenesulfonate surfactant (LAS), if used in the composition of the present invention, preferably has a straight chain alkyl radical of average length of about 11 to 13 carbon atoms.

Specific sulfated surfactants which can be used in the compositions of the present invention include sulfated ethoxylated and unethoxylated fatty alcohols, preferably linear primary or secondary monohydric alcohols with $C_{10}$–$C_{18}$, preferably $C_{12}$–$C_{16}$, alkyl groups and, if ethoxylated, on average about 1–15, preferably 3–12 moles of ethylene oxide (EO) per mole of alcohol, and sulfated ethoxylated alkylphenols with $C_8$–$C_{16}$ alkyl groups, preferably $C_8$–$C_9$ alkyl groups, and on average from 4–12 moles of EO per mole of alkyl phenol.

The preferred class of anionic surfactants are the sulfated ethoxylated linear alcohols, such as the $C_{12}$–$C_{16}$ alcohols ethoxylated with an average of from about 1 to about 12 moles of ethylene oxide per mole of alcohol. A most preferred sulfated ethoxylated detergent is made by sulfating a $C_{12}$–$C_{15}$ alcohol ethoxylated with 3 moles of ethylene oxide per mole of alcohol.

Specific nonionic surfactants which can be used in the compositions of the present invention include ethoxylated fatty alcohols, preferably linear primary or secondary monohydric alcohols with $C_{10}$–$C_{18}$, preferably $C_{12}$-$C_{16}$, alkyl groups and on average about 1–15, preferably 3–12 moles of ethylene oxide (EO) per mole of alcohol, and ethoxylated alkylphenols with $C_8$–$C_{16}$ alkyl groups, preferably $C_8$–$C_9$ alkyl groups, and on average about 4–12 moles of EO per mole of alkyl phenol.

The preferred class of nonionic surfactants are the ethoxylated linear alcohols, such as the $C_{12}$–$C_{16}$ alcohols ethoxylated with an average of from about 1 to about 12 moles of ethylene oxide per mole of alcohol. A most preferred nonionic detergent is a $C_{12}$–$C_{15}$ alcohol ethoxylated with 3 moles of ethylene oxide per mole of alcohol.

Mixtures of the foregoing synthetic detergent type of surfactants, e.g., of anionic and nonionic, or of different specific anionic or nonionic surfactants, may be used to modify the detergency, sudsing characteristics, and other properties of the composition. For example, a mixture of different fatty alcohols of 12 to 15 carbon atoms may be ethoxylated, directly sulfated, or sulfated after ethoxylation, a fatty alcohol may be partially ethoxylated and sulfated, or an ethoxylated fatty acid may be partially sulfated to yield a mixture of different anionic and nonionic surfactants or different specific anionic or nonionic surfactants.

The total active surfactant in the composition may be in the range, for example, of about 5 to 15 wt. % preferably about 8 to 12 wt. % based on the weight of solids in the composition. If, as preferred, the active surfactant consists of a combination of anionic and nonionic surfactants, then the anionic surfactant is present in the range, for example, of about 4 to 14 wt. %, preferably about 5 to 10 wt. %, and the nonionic surfactant is present in the range, for example, of about 2 to 8 wt. %, preferably about 3 to 5 wt. %, all based on the weight of total solids.

The detergent composition of this invention is preferably in the form of a dry-appearing powder, in which case the weight percentages of the various components mentioned previously are approximately based on the weight of the total composition. However, such dry appearing powder generally contains water in an amount, for example, of about 1 to 12 wt. %, preferably about 2 to 10 wt. % based on the weight of the total composition. Alternatively, however, the detergent composition may be in the form of a liquid, e.g., an aqueous solution of the detergent components containing, for example, about 0.5 to 30 wt. % of detergent solids.

The laundry detergent compositions of this invention may also contain in addition to the components described previously, one or more adjuvants common to detergent formulations such as optical brighteners, enzymes, carboxymethylcellulose, perfumes, germicidal agents and coloring agents. The total of the foregoing adjuvants may be up to about 20 wt. %, i.e., 0 to 20 wt. % of the composition. In addition, the composition may contain small amounts of one or more reaction products of the previously described components, e.g., sodium sulfate formed by the reaction of sodium carbonate and/or bicarbonate and sulfate in the anionic surfactant.

In some cases the detergent compositions described herein may "consist essentially" of the previously delineated components, i.e., the composition does not contain any other component which affects the basic and novel characteristics of the described compositions containing such delineated components.

In other cases, the detergent compositions described herein may "consist" of the previously delineated components, i.e., the composition does not contain any components other than such delineated components.

The detergent compositions of this invention are particularly effective for the washing of fabrics at a temperature below about 122° F. (50° C.).

The following examples further illustrate the invention.

EXAMPLES 1–5 AND COMPARATIVE EXAMPLE A

These examples illustrate the effect in reducing fabric encrustation of the presence in the wash liquor of dissolved zinc with a standard detergent formulation.

In each of these examples, encrustation determinations were carried out using cleaning formulations comprising a laboratory prepared base detergent composition consisting of, by weight, 80 parts of sodium carbonate, 0.5 parts of sodium bicarbonate, an active surfactant consisting of 6.0 parts of the sodium salt of a sulfated $C_{12}$–$C_{15}$ alcohol (anionic surfactant) and 3.2 parts of a $C_{12}$–$C_{15}$ alcohol ethoxylated with 3 moles of ethylene oxide per mole of alcohol (nonionic surfactant), about 1.2 parts on a dry basis of Rohm and Haas 912 polymer, which is a polymeric blend of 50 wt. % of a polyacrylic acid having a number average molecular weight of about 4500, and 50 wt. % of a copolymer of 50:50 acrylic and methacrylic acids having a number average molecular weight of 3500, and about 8.8 parts of water, with the wash water containing 250 ppm of calcium and magnesium hardness as $CaCO_3$ with a Ca/Mg molar ratio of 2/1, such hardness as $CaCO_3$ determined as described in ASTM D 1126-86 of October 1986.

The polymer is completely neutralized on being dissolved with the sodium carbonate in the formulation. In comparative Example A the formulation was tested as is without the addition of any zinc to the wash liquor. In Examples 1 to 5, varying amounts of zinc sulfate heptahydrate were added to the wash liquor such that the amount of elemental zinc in the wash liquor varied from 1 to 40 ppm.

The six detergent compositions were tested for fabric encrustation by repeated washing of cotton fabric at 95° C. In carrying out each test, four 25.4 cm.×25.4 cm., 100% black cotton fabric swatches along with 0.907 kg. of ballast are washed for 9 min. with 113.4 g of the detergent composition being tested such that the wash liquor contained about 0.162 wt. % of detergent. After washing is completed, 2.00–4.00 g of the calcium carbonate encrusted fabrics are extracted in 100 ml. of 0.2N hydrochloric acid for 30 min. and a 2.0–4.0 ml. aliquot is analyzed for hardness by the EDTA titration method. Encrustation is expressed as mg. calcium carbonate per gram of fabric obtained after five machine cycles of use. The results are shown in Table I.

TABLE 1

| Example | Zn Concentration in Wash Liquor, ppm | Encrustation, mg $CaCO_3$/g fabric |
|---|---|---|
| A | 0 | 112 |
| 1 | 1 | 30 |
| 2 | 5 | 15 |
| 3 | 10 | 15 |
| 4 | 20 | 13 |
| 5 | 40 | 12 |

The visual ranking of the swatches used in these examples from best appearance to worst is as follows.

*40 ppm Zn=20 ppm Zn>10 ppm Zn=5 ppm Zn>1 ppm Zn>0 ppm Zn*

The results of the examples indicate that while the amount of $CaCO_3$ encrustation goes down as the concentration of zinc in the wash liquor is increased from 0 to 40 ppm, the greatest improvement occurs from 0 to 1 ppm, with a smaller though still appreciable improvement from 1 to 5 ppm and only slight improvement from 5 to 40 ppm.

EXAMPLES 6 TO 8 AND COMPARATIVE EXAMPLE B

These examples indicate that the advantage of reduced encrustation may be obtained if the zinc salt is included directly in the detergent composition rather than being added separately to the wash liquor.

The procedure of Examples 1 to 5 was followed except that the zinc sulfate heptahydrate was blended directly with the components of the detergent composition to obtain formulations containing from 0 to 0.6 wt. % of elemental zinc based on the weight of solids in the composition. The results of the 5-cycle washing tests are shown in Table 2.

TABLE 2

| Example | Zn Concentration in Detergent Formulation, wt. % | Encrustation, mg $CaCO_3$/g fabric |
|---|---|---|
| B | 0 | 111 |
| 6 | 0.06 | 39 |
| 7 | 0.3 | 19 |
| 8 | 0.6 | 16 |

The results of these examples show that the amount of encrustation decreases as the amount of zinc in the detergent composition is increased from 0 to 0.06 wt. %, with the greatest decrease in encrustation occurring with an increase in the zinc content from 0 to 0.06 wt. %, and a smaller but still significant encrustation reduction obtained when the zinc is increased from 0.06 to 0.3 wt. %.

EXAMPLES 9 TO 11 AND COMPARATIVE EXAMPLE C

These examples illustrate the effect of reduced encrustation caused by varying zinc content at higher stress conditions caused by an increased water hardness level.

The procedures of Examples 6–8 was followed except that the calcium and magnesium hardness level of the wash water was 350 ppm determined as $CaCO_3$ and the standard detergent formulation to which the zinc salt was added was plant made, i.e. prepared by means of a commercial plant process, which differs from the laboratory prepared formulation described in Example 1 only in that it contains 0.124 wt. % of perfume in addition to the components making up such laboratory prepared formulation. In these examples, the percentage of elemental zinc in the detergent formulation was varied from 0 to 0.6 wt. %. The results are shown on Table 3 which indicates for each example the concentration of elemental zinc in the detergent formulation. (Zn in formul.) and wash liquor (Zn in wash liq.) and the resulting fabric encrustation (Encrust.).

TABLE 3

| Example | Zn in formul., wt. % | Zn in wash liq., ppm | Encrust mg. $CaCO_3$/g. fabric |
|---|---|---|---|
| C | 0 | 0 | 163 |
| 9 | 0.06 | 1 | 81 |
| 10 | 0.3 | 5 | 30 |
| 11 | 0.6 | 10 | 20 |

The results of Table 3 show that the process of the invention is effective in reducing fabric encrustation when the wash water has the relatively high calcium and magnesium hardness of 350 ppm.

EXAMPLES 12 TO 14 AND COMPARATIVE EXAMPLE D

These examples illustrate the use of zinc sulfate monohydrate as the zinc salt of this invention.

The procedure of Examples 6–8 was followed except that the base detergent formulation to which the zinc salt was added was plant made and the zinc salt was zinc sulfate monohydrate. Results are shown in Table 4.

TABLE 4

| Example | Zn in formul., wt. % | Zn in wash liq., ppm | Encrust., mg. $CaCO_3$/g. fabric |
|---|---|---|---|
| D | 0 | 0 | 105 |
| 12 | 0.36 | 6 | 20 |
| 13 | 0.72 | 12 | 14 |
| 14 | 1.44 | 24 | 15 |

These results of Table 4 indicate that the use of minor amounts of zinc sulfate monohydrate of at least 0.36 wt. % of the detergent formulation are effective in substantially reducing encrustation.

EXAMPLES 15 TO 18

These examples illustrate the effect on encrustation of combinations of relatively high and low concentrations of polymeric polycarboxylate and zinc in the detergent formulation.

The procedure of Examples 6–8 was followed except that varying combinations of 0.3 and 0.6 wt. % of elemental zinc and 1.2 and 0.6 wt. % on a dry basis of Rohm and Haas 912 polymer as the polymeric polycarboxylate were utilized in the detergent formulation. Results are shown in Table 5 which includes the concentration of 912 polymer in the detergent formulation (Polym. in formul.) as well as the zinc concentration and encrustation as shown in the previous tables. Table 5 also includes the results of Comparative Example B previously described, for comparison.

TABLE 5

| Example | Polym. in formul., wt. % | Zn in formul., wt. % | Zn in wash liq., ppm | Encrust mg. $CaCO_3$/g. fabric |
|---|---|---|---|---|
| B | 1.2 | 0 | 0 | 111 |
| 15 | 1.2 | 0.3 | 5 | 17 |
| 16 | 0.6 | 0.3 | 5 | 20 |
| 17 | 1.2 | 0.6 | 10 | 13 |
| 18 | 0.6 | 0.6 | 10 | 16 |

These results show that the lower concentration of 0.6 wt. % polymer in the detergent formulation is as effective in reducing encrustation as the higher concentration of 1.2 wt. % polymer at zinc concentrations of 0.3 and 0.6 wt. %.

EXAMPLES 19 TO 22

These examples illustrate the effectiveness of the invention in reducing encrustation at four different concentrations of polymeric polycarboxylate and a single concentration of zinc in the detergent formulation.

The procedure of Examples 6–8 was followed except that the levels of polymeric polycarboxylate and zinc were varied as described. Results are shown in Table 6 which also includes the results of Comparative Example B for comparison.

TABLE 6

| Example | Polym. in formul., wt. % | Zn in formul., wt. % | Zn in wash liq., ppm | Encrust mg. $CaCO_3$/g. fabric |
|---|---|---|---|---|
| B | 1.2 | 0 | 0 | 111 |
| 19 | 1.2 | 0.3 | 5 | 14 |
| 20 | 0.6 | 0.3 | 5 | 17 |
| 21 | 0.3 | 0.3 | 5 | 19 |
| 22 | 0.15 | 0.3 | 5 | 23 |

These results show that the inventive composition is effective in reducing encrustation at widely varying concentrations of polymeric polycarboxylate and a concentration of zinc of 0.3 wt. %.

COMPARATIVE EXAMPLES E TO H

These examples illustrate the effect of an absence of polymeric polycarboxylate on detergent compositions containing widely varying zinc concentrations.

The procedure of Examples 6–8 was followed using varying amounts of zinc sulfate heptahydrate except that no polymeric polycarboxylate was present in the formulations. Results are shown in Table 7 which includes the details of Comparative Example B, wherein the formulation contained polymeric polycarboxylate but no zinc, for comparison.

TABLE 7

| Example | Polym. in formul., wt. % | Zn in formul., wt. % | Zn in wash liq., ppm | Encrust mg. $CaCO_3$/g. fabric |
|---|---|---|---|---|
| B | 1.2 | 0 | 0 | 111 |
| E | 0 | 0.06 | 1 | 111 |

TABLE 7-continued

| Example | Polym. in formul., wt. % | Zn in formul., wt. % | Zn in wash liq., ppm | Encrust mg. $CaCO_3$/g. fabric |
|---|---|---|---|---|
| F | 0 | 0.3 | 5 | 91 |
| G | 0 | 0.6 | 10 | 121 |
| H | 0 | 1.2 | 20 | 106 |

These results indicate that no significant reduction in encrustation is obtained by the addition of varying amounts of zinc salts to a formulation containing no polymeric polycarboxylate, as compared with a standard formulation containing polymeric polycarboxylate but no soluble zinc salt. Thus a minor amount of polymeric polycarboxylate must be present in the formulation in order to obtain a significant reduction in encrustation by the addition of soluble zinc salt.

EXAMPLES 23 AND 24 AND COMPARATIVE EXAMPLE I

The procedure of Examples 12 to 14 utilizing zinc sulfate monohydrate as the zinc salt was followed except that 30 min. rather than 9 min. wash cycles were carried out. Results are shown in Table 8.

TABLE 8

| Example | Zn in formul., wt. % | Zn in wash liq., ppm | Encrust mg. $CaCO_3$/g. fabric |
|---|---|---|---|
| I | 0 | 0 | 111 |
| 23 | 0.36 | 6 | 36 |
| 24 | 0.72 | 12 | 30 |

The results of Table 8 indicate that encrustation was significantly reduced by the addition of a water soluble zinc salt with 30 min. wash cycles although not to as great an extent as with 9 min. wash cycles.

EXAMPLES 25 TO 27

These examples illustrate the effect on encrustation obtained by using salts other than zinc sulfate in the detergent compositions of this invention.

The procedure of Example 6 to 8 was followed except that three different zinc salts were utilized, each in an amount of 0.3 wt. % of elemental zinc in the detergent formulation and 5 ppm in the wash liquor. The salts were zinc chloride, zinc acetate dihydrate, and zinc citrate. Table 9 shows the results of the fabric encrustation determinations and includes the details of Example 7 wherein zinc sulfate heptahydrate in an amount of 0.3 wt. % of elemental zinc was present in the detergent formulation, and Comparative Example D wherein no zinc was present, for comparison.

TABLE 9

| Example | Zinc Salt | Encrustation mg. $CaCO_3$/g. fabric |
|---|---|---|
| D | none | 105 |
| 7 | sulfate ($7H_2O$) | 19 |
| 25 | chloride | 16 |
| 26 | acetate ($2H_2O$) | 21 |
| 27 | citrate | 62 |

The results of Table 9 indicate that all the zinc salts shown were effective in reducing fabric encrustation, although zinc citrate was less effective than the others apparently because of its lower solubility.

EXAMPLES 28 TO 31 AND COMPARATIVE EXAMPLE J

These examples illustrate the effect in reduced encrustation of using zinc sulfate monohydrate in the detergent formulation in amounts under 0.36 wt. % as elemental zinc.

The procedure of Examples 12–14 was followed using varying amounts of zinc sulfate monohydrate under 0.36 wt. % of the detergent composition expressed as elemental zinc. Results are shown in Table 10.

TABLE 10

| Example | Zn in formul., wt. % | Zn in wash liq., ppm | Encrust mg. $CaCO_3$/g. fabric |
|---|---|---|---|
| J | 0 | 0 | 126 |
| 28 | 0.09 | 1.5 | 32 |
| 29 | 0.18 | 3 | 18 |
| 30 | 0.27 | 4.5 | 17 |
| 31 | 0.36 | 6 | 16 |

The results of Table 10 indicate that significantly reduced encrustations are obtained when amounts of zinc sulfate monohydrate equivalent to substantially less than 0.3 wt. % of elemental zinc in the detergent composition are utilized.

It has been found that the foregoing decreases in encrustation caused by the introduction of zinc into the wash system are obtained with little or no sacrifice in the cleaning ability or the detergency of the cleaning composition.

I claim:

1. A non-bleaching laundry detergent composition wherein the solids content comprises an active surfactant, at least about 70 wt. % of a water-soluble alkaline carbonate, about 0.05 to 5 wt. % of a completely or partially neutralized polymeric polycarboxylate having a number average molecular weight of 1000 to 10,000, and about 0.01 to about 1.5 wt. % of elemental zinc in the form of a water soluble salt, said surfactant being a synthetic anionic, nonionic, amphoteric, or zwitterionic detergent active compound, or a mixture thereof, and said polymeric polycarboxylate being selected from the group consisting of 1) homopolymers of each of the following unsaturated acid monomers: acrylic acid, methacrylic acid, diacids selected from the group consisting of maleic acid, itaconic acid, fumaric acid, mesoconic acid and citraconic acid, and monoesters of any of said diacids with an alkanol having 1–8 carbon atoms; 2) copolymers of more than one of said unsaturated acid monomers; 3) copolymers of at least about 50 mol % of at least one of said unsaturated acid monomers with at least one of the following non-carboxylic acid unsaturated monomers: styrene, ethylene, propylene, butene-1, vinyl acetate, vinyl chloride, vinyl alcohol, alkyl acrylates, vinyl pyridine, vinyl pyrrolidone, and amides of any of said unsaturated acid monomers; and 4) mixtures thereof.

2. The composition of claim 1 wherein said alkaline carbonate comprises an alkali metal carbonate.

3. The composition of claim 2 wherein said alkali metal carbonate is sodium carbonate.

4. The composition of claim 3 comprising about 75 to 80 wt. % of sodium carbonate and about 0.1 to 15 wt. % of sodium bicarbonate.

5. The composition of claim 1 wherein said molecular weight is about 2000 to 5000.

6. The composition of claim 1 wherein said polymeric polycarboxylate comprises an acrylic acid polymer.

7. The composition of claim 1 in the form of a dry-appearing powder containing about 1 to 12 wt. % of water.

8. The composition of claim 1 comprising at least one adjuvant selected from the group consisting of optical brighteners, carboxymethylcellulose, perfumes, germicidal agents and coloring agents.

9. The composition of claim 1 wherein said elemental zinc comprises about 0.06 to 1 wt. % of the total solids.

10. The composition of claim 1 wherein said water soluble salt is hydrated or anhydrous zinc sulfate, hydrated or anhydrous zinc acetate, zinc chloride, zinc nitrate, or zinc citrate.

11. The composition of claim 10 wherein said water soluble salt is a hydrated or anhydrous zinc sulfate.

12. The composition of claim 11 wherein said zinc sulfate is zinc sulfate heptahydrate or monohydrate.

13. The composition of claim 1 wherein said active surfactant comprises an anionic surfactant and a nonionic surfactant.

14. The composition of claim 13 wherein said anionic surfactant is an alkali metal salt of sulfated linear $C_{12}$–$C_{16}$ alcohols ethoxylated with an average of 1 to 12 moles of ethylene oxide per mole of alcohol and is present in an amount of about 4 to 14 wt. %, and said nonionic surfactant consists of $C_{12}$–$C_{16}$ linear alcohols ethoxylated with an average of 1 to 12 moles of ethylene oxide per mole of alcohol and is present in an amount of about 2 to 8 wt. % based on the weight of total solids.

15. A process comprising washing a fabric in an aqueous wash liquor containing the composition of claim 1.

16. The process of claim 15 wherein said washing is carried out at a temperature no higher than about 122° F. (50° C.).

* * * * *